US008020729B2

(12) United States Patent
Dubach

(10) Patent No.: US 8,020,729 B2
(45) Date of Patent: Sep. 20, 2011

(54) CLOSABLE OPENING DEVICE PRODUCED WITH A SEMIFINISHED PRODUCT AND METHOD OF FITTING THE SAME

(75) Inventor: Werner Fritz Dubach, Maur (CH)

(73) Assignee: Deltona Innovations AG, Maur (CH)

( * ) Notice: Subject to any disclaimer, the term of this patent is extended or adjusted under 35 U.S.C. 154(b) by 448 days.

(21) Appl. No.: 12/084,664

(22) PCT Filed: Oct. 27, 2006

(86) PCT No.: PCT/CH2006/000601

§ 371 (c)(1),
(2), (4) Date: Oct. 1, 2008

(87) PCT Pub. No.: WO2007/051328

PCT Pub. Date: May 10, 2007

(65) Prior Publication Data

US 2009/0250488 A1 Oct. 8, 2009

(30) Foreign Application Priority Data

Nov. 7, 2005 (CH) ..... 1778/05

(51) Int. Cl.
*B67D 1/00* (2006.01)

(52) U.S. Cl. ..... 222/83; 222/81; 222/83.5; 222/91; 222/519; 222/541.1; 222/541.2; 222/568; 220/278

(58) Field of Classification Search ..... 222/1, 80–81, 222/83, 83.5, 86, 88–91, 519–520, 525, 541.2, 222/541.6, 566, 568, 541.1; 220/277–278
See application file for complete search history.

(56) References Cited

U.S. PATENT DOCUMENTS

| | | | | |
|---|---|---|---|---|
| 5,141,133 | A | 8/1992 | Ninomiya et al. | |
| 5,348,182 | A | 9/1994 | Luch | |
| 5,482,176 | A * | 1/1996 | Maietta et al. | 220/277 |
| 6,279,779 | B1 * | 8/2001 | Laciacera et al. | 222/83 |
| 6,398,075 | B1 * | 6/2002 | Laciacera et al. | 222/91 |
| 6,702,161 | B2 * | 3/2004 | Adams et al. | 222/521 |
| 6,820,764 | B2 * | 11/2004 | Miani et al. | 222/83 |
| 6,851,576 | B2 * | 2/2005 | Dubach | 222/83 |
| 7,036,683 | B2 * | 5/2006 | Dubach | 222/83 |
| 7,207,465 | B2 * | 4/2007 | Weist | 222/83 |
| 7,484,641 | B2 * | 2/2009 | Casale et al. | 222/83.5 |
| 7,540,405 | B2 * | 6/2009 | Sase et al. | 229/125.14 |
| 2006/0144852 | A1 | 6/2006 | Dubach | |

FOREIGN PATENT DOCUMENTS

| | | | |
|---|---|---|---|
| EP | 1 084 060 | A1 | 3/2001 |
| EP | 1 088 764 | A1 | 4/2001 |
| WO | WO 99/62776 | | 12/1999 |
| WO | WO 02/28728 | A | 4/2002 |
| WO | WO 2004/083054 | A | 9/2004 |

* cited by examiner

*Primary Examiner* — Frederick C. Nicolas
(74) *Attorney, Agent, or Firm* — Pauley Petersen & Erickson

(57) ABSTRACT

A pouring nozzle with a flange and an internal thread and an external thread, and also a cutting element having an upper rim and a lower rim formed with teeth. A screw cap with catches acts on catches of the cutting element. To make fitting easier, the cutting element and the pouring nozzle are produced as a one-piece semifinished product, wherein the cutting element is connected to the lower rim by weakened bridges so that the lower rim of the cutting element lies in a plane with the upper rim of the pouring nozzle and the teeth are protected in the pouring nozzle. This structural design allows an easy fitting which also reduces the reject rate.

8 Claims, 4 Drawing Sheets

CLOSABLE OPENING DEVICE PRODUCED WITH A SEMIFINISHED PRODUCT AND METHOD OF FITTING THE SAME

BACKGROUND OF THE INVENTION

1. Field of the Invention

This invention relates to a closable opening device for a sealed packaging, which includes a flowable medium, wherein the device encompasses a pouring nozzle with a flange, having an internal thread and an external thread, as well as a cylindrical cutting element, which has an upper rim, which defines a planar surface. The lower rim has a tooth or a plurality of teeth, and an internal jacket surface has catches, which act in a radial direction and which interact with catches in a screw cap so that the cutting element pierces the packaging in a screw motion, wherein the pouring nozzle with the flange and the cylindrical cutting element are produced as a one-piece semifinished product.

2. Discussion of Related Art

A closable opening device of the afore-mentioned type is taught by European Patent Reference EP-A-1,088,764. A principle, which is common in closure technology, wherein multi-part closures are produced so that two parts are arranged on top of one another and are injection molded in one piece to be connected to one another via predetermined breaking points. In this connection, the expenditure of tools is reduced because the fitting is simplified, and because the parts connected to one another via predetermined breaking points are arranged in their accurately aligned relative position to one another and must thus only be pushed together. This sufficiently known technology has also been used for the closures, which are of interest, and is also taught by European Patent Reference EP-A-1,084,060, for example. The opening device disclosed differs from the former opening device taught by European Patent Reference EP-A-1,088,764 because the cutting element does not encompass a planar surface at its upper end, but an inclined surface, which bears on a similarly inclined opposite surface in response to the initial actuation of the closing device and which exerts a straight purely transversal force acting at right angles on the packaging to be pierced. This type of motion is in contrast to the type of motion according to European Patent Reference EP-A-1,088,764, which is of interest, where the cutting element is moved through the packaging in a screw motion.

Both documents disclose a semifinished product, which shows a one-piece production of a pouring nozzle including a flange together with a cylindrical cutting element. The cutting element according to European Patent Reference EP-A-1,084,060 does not have a planar surface, neither at the upper nor at the lower rim, which is suitable for being connected to an upper or a lower rim of the pouring nozzle in a revolving manner. A solution is thus disclosed in which the cutting element is produced in an intermediate layer within the pouring nozzle via predetermined breaking points produced as a semifinished product, to be connected to the lower rim of the pouring nozzle via predetermined breaking points.

However, the prefitting, where the cutting element must be inserted into the pouring nozzle, is not as trivial in both of the solutions as it may appear. The mentioned packaging made of laminate, onto which the closing devices, which are of interest herein, are mounted, include at least one plastic film layer, which is difficult to cut through because the material is very tough and must be pierced. This requires for the teeth or for at least the one tooth to be correspondingly sharp and to encompass a sufficient solidity. If the pouring nozzle and the cutting element are simply be pushed together without corresponding specific arrangements by pressure applied from the top and the bottom, the highly delicate teeth would bend, break or would at least become blunt. Consequently, the mode of operation of the opening device is no longer guaranteed. To avoid this, correspondingly complicated fitting devices are used, in which the semifinished products are introduced in an accurately positioned manner and are pushed together only thereafter. Such a fitting is not only correspondingly expensive in terms of equipment, but the fitting speed is relatively slow for a bulk material and causes a large amount of rejects.

SUMMARY OF THE INVENTION

It is one object of this invention to provide a closable opening device of the afore-mentioned type but wherein a semifinished product is used, which can be fitted in a considerably simpler and more cost-efficient manner without having to affect the teeth.

It is another object of this invention to provide a method by which the semifinished product of the newly created opening device can be fitted in a particularly cost-efficient manner and with high speed. This object is solved by a method having features described in this specification and in the claims.

The seemingly trivial solution of this invention overcomes a preconception of the person of skill in the art. Until now, experts have considered the solution chosen herein, where the cutting element is injection molded with its lower rim to the upper rim of the pouring nozzle via predetermined breaking points, to be unsuitable, because the upper rim of the pouring nozzle cooperates together with a ring-shaped sealing bead at the interior of the cap. The mounting of predetermined breaking points in this region was considered unusable, because this produces defects at the upper rim of the pouring nozzle and experts were convinced that the opening device, which is of interest herein, would no longer be closable to thus form a seal. However, tests have shown that such a solution can be realized without creating hereby an opening device, which is leaky when in a closed state. The residual appendages remaining at the pouring nozzle are so small that the seal is not influenced through this because the predetermined breaking points are designed as discussed in this specification and in the claims. However, this is not a mandatory prerequisite for realizing this invention, but only represents an optimization, while another solution would be for the ring-shaped sealing wall including the revolving sealing bead integrally molded thereon to be designed as slightly longer so that it penetrates further into the spout of the pouring nozzle when in the closed state. Thus, the cutting element should be pushed slightly deeper into the pouring nozzle, such as by a method as discussed in this specification and in the claims.

BRIEF DESCRIPTION OF THE DRAWINGS

One exemplary embodiment of this invention is illustrated in the attached drawings and the design thereof as well as the method according to this invention is explained in view of the description below, wherein.

DETAILED DESCRIPTION OF THE INVENTION

Figure 1:
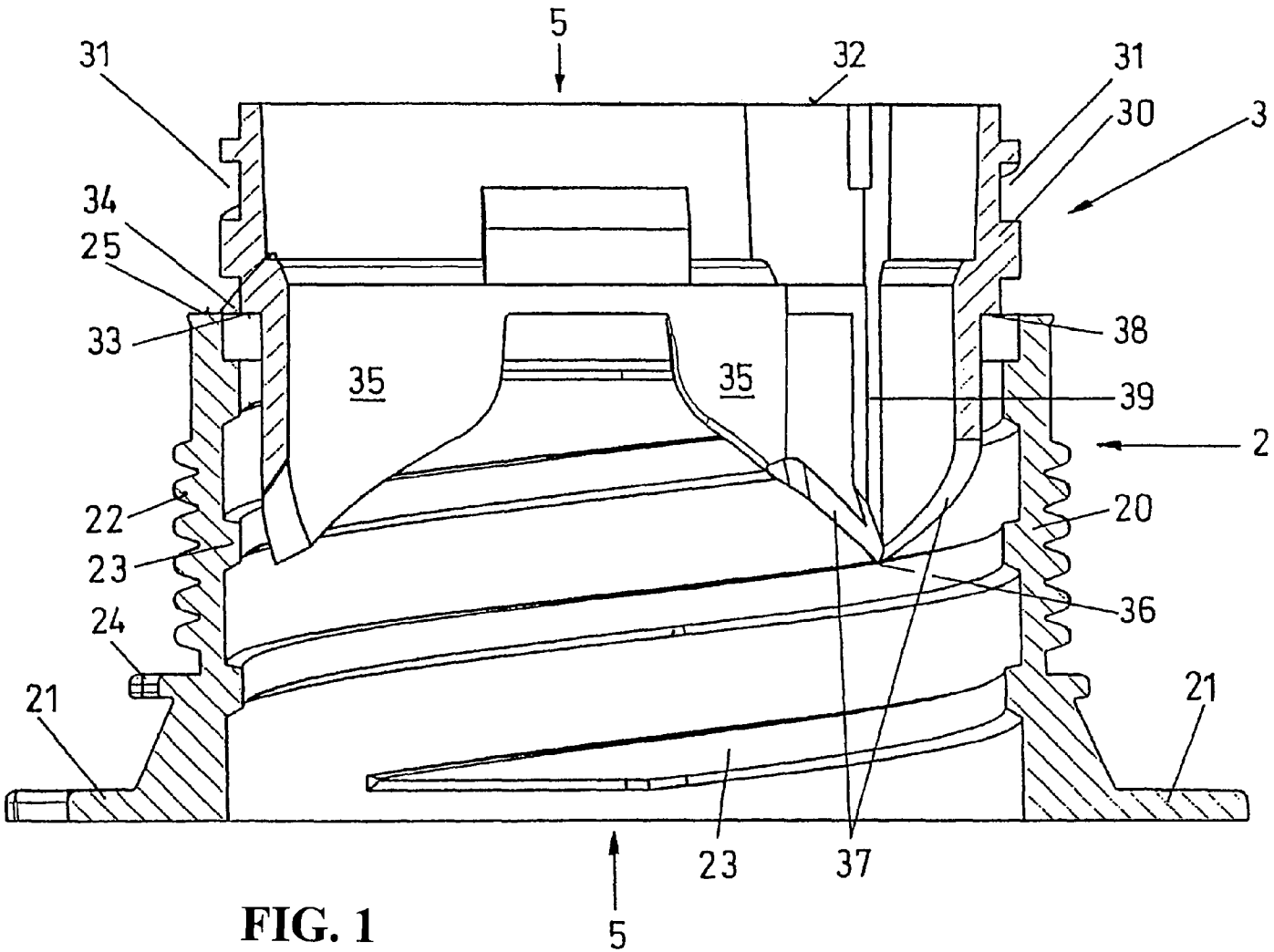
FIG. 1 shows a vertical sectional view taken through a semifinished product in a production facility in which the cutting element is held above the pouring nozzle via predermined breaking points.
Figure 2:
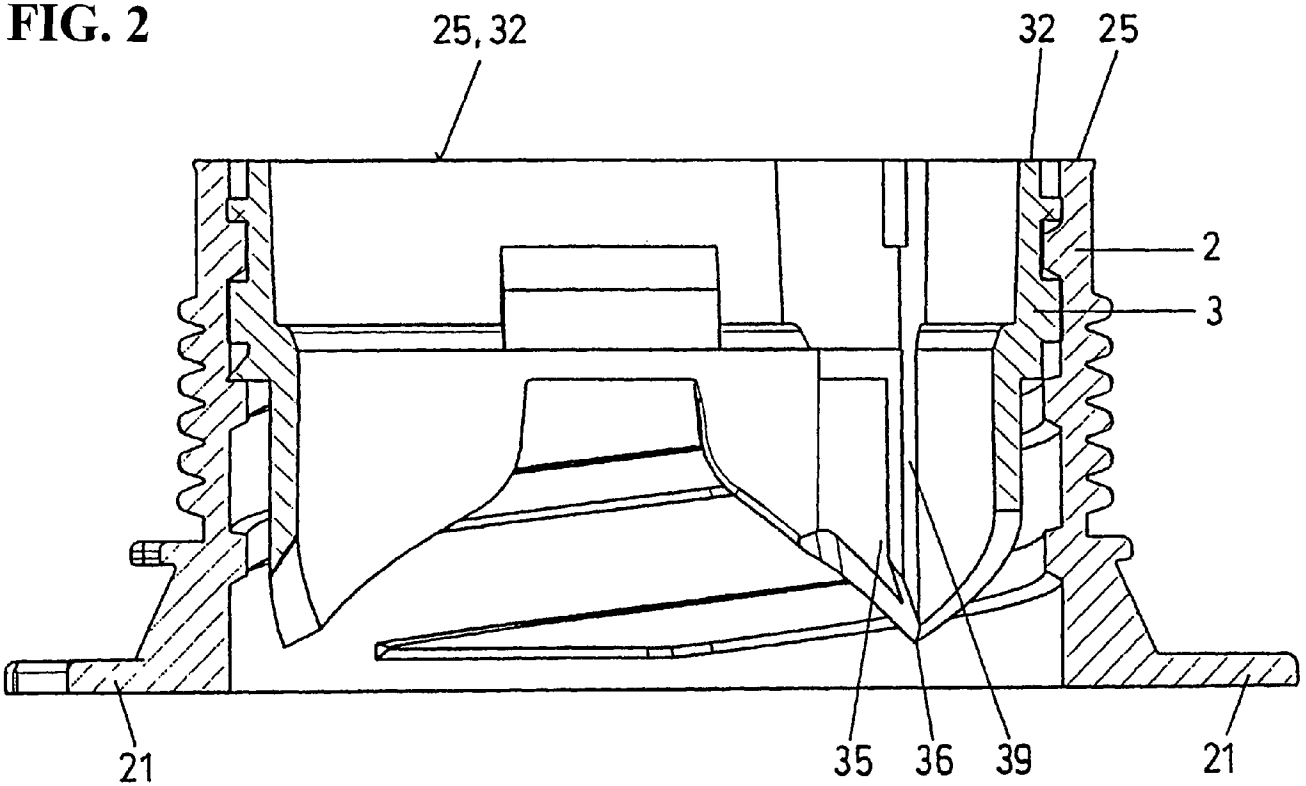
FIG. 2 shows the semifinished product in a fitted state.
Figure 3:
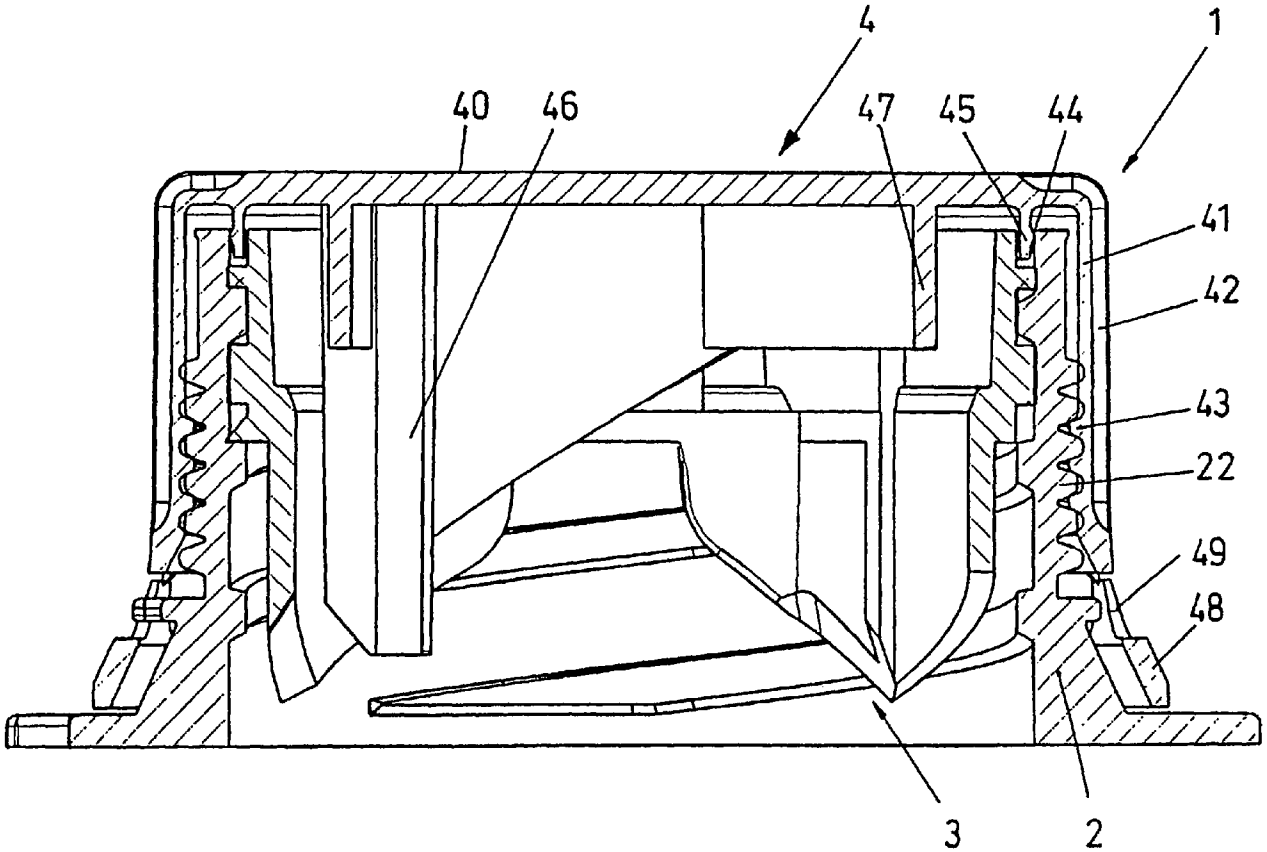
FIG. 3 shows a closed opening device in a state prior to the initial opening, again in a vertical view.

As shown in FIG. 3, the main components of the opening device are collectively characterized with element reference numeral 1. The opening device encompasses the three main components, a pouring nozzle 2 as well as a cutting element 3 supported therein in a movable manner and a cap 4, which close the opening device. The two main components 2 and 3, namely the pouring nozzle and the cutting element, are produced in one piece in terms of production and form a semifinished product, which is characterized with element reference numeral 5 and which is shown in FIG. 1 on its own in the production position.

The semifinished product 5 including the pouring nozzle 2 and the cutting element 3, facilitates the fitting of these two parts and also the production of a semifinished product which considerably reduces the tool costs. Because it is not necessary to produce two individual parts, the machine costs are also reduced.

The pouring nozzle 2 is formed by a cylindrical pipe section 20, which encompasses a terminal flange 21 at its lower end. The cylindrical pipe section 20 has an external thread 22 and an internal thread 23. The external thread 22 can be designed as a so-called fine thread, wherein the cross section of the thread encompasses a rounded shape. This fine thread has the advantage that a cap 4, which is to be placed thereon, can be pushed open in a ratchet-like manner with a relatively small effort, wherein the appropriate internal thread of the cap slides over the external thread 22. It is possible with this to fit the cap without performing a rotary motion, which is necessary because the cap itself encompasses an interact with the cutting element 3 so that a twist of the cap causes a rotary motion of the cutting element 2 in the opposite direction.

Provision is made for the flange 21 but below the external thread 22 for one or a plurality of separating agents 24, which have the shape of fingers directed in a radially outward direction. In the fitted state of the opening device, the finger-shaped separating agents 24 engage between predetermined breaking points below the lower rim of the cap 4, wherein the predetermined breaking points hold a tamper-proof seal, which is integrally molded at the lower rim of the cap 4. In response to the initial actuation of the opening device 1, the separating agents 24 shear the predetermined breaking points from the cap 4 and thus separate the tamper-proof seal from the cap 4. The upper rim of the pouring flange 25 defines a planar surface, which runs parallel to the flange 21. The interior thread 23 at the pouring nozzle 2 encompasses a considerably greater incline than the fine thread 22 at the outside of the pouring nozzle 2. The cross section of this internal thread is trapezoidal. With this trapezoidal shape, the cutting element 3 can be pushed into the pouring nozzle 2 with a reduced resistance without destroying the threads.

As a whole, the cutting element is characterized with element reference numeral 3 which encompasses a cylindrical tube section 30, into which an external thread 31 is inserted. The shape of the external thread 31 is matched to the internal thread 23 of the pouring nozzle 2 and meshes with the internal thread in response to the initial actuation of the opening device. The cylindrical pipe section 30 encompasses an upper rim 32, which defines a planar surface, which in turn runs parallel to the plane defined by the flange 21. The lower rim of the cutting element 3 is characterized with element reference numeral 33. In the production facility of the semifinished product 5, the lower rim 33 is located at least approximately in the region of or near the upper rim 25 of the pouring nozzle 2 and is connected in this state to the pouring nozzle 2 in one piece. The connection establishes a plurality of weakened bridges 34. Only one weakened bridge 34 is shown in FIG. 1, because the weakened bridges 34 in this case are not mounted to be located diametrically across from one another. However, this would also be a possible embodiment. Sensibly, the weakened bridges 34 are arranged evenly distributed across the periphery, wherein the number can be even or uneven. In the instant case, the number is assumed to be uneven, which is why a weakened bridge 34, which is located diametrically opposite thereto, is not visible. The cutting element 3 has a random number of teeth 35, which can be arranged to be distributed across the periphery in an even or uneven manner. The teeth 35 have a sharp point 36, which serves the piercing of the packaging and corresponding cutting edges 37 that follow, which are capable of cutting the pierced packaging film. The teeth 35 are located on an annulus, which is offset inwardly as compared to the cylindrical pipe section 30 by virtually at least half of the wall thickness of the cylindrical pipe section 30. The result is a revolving shoulder 38, which protrudes outwardly. In the instant case, the revolving shoulder 38 forms the lower rim 33 of the cylindrical pipe section 33 of the cutting element 3.

With this projection 38, the weakened bridges 34 can be designed very short and small. The distance between the lower rim 33 of the cutting element 3 and the upper rim 25 of the cylindrical pipe section 20 of the pouring nozzle 2 can thus virtually be reduced to the size of the thread height of the internal thread 23. Due to the annulus comprising the teeth 35, which is repositioned to the inside, a sufficient tool wall remains between the teeth 35 and the interior surface of the cylindrical pipe section 20 of the pouring nozzle 2, so that the injection molding tool is not damaged by being removed from the mold and can also have sufficient cooling.

Finally, the cutting element 3 encompasses at least one catch 39, which runs from the upper rim 32 of the cutting element in axial direction downwards and which is directed at least approximately towards the center. The catch 39, which substantially has the shape of a longitudinal rib, is sensibly arranged so that it extends from the upper rim 32 to the point 36 of a tooth 35. Due to the fact that only one such catch is required, the catches are not visible on all of the teeth.

With reference to the description of the third main component of the opening device 1, the cap 4, reference is made to FIG. 3. In this view, the opening device 1 is illustrated in a completely fitted state prior to the initial opening. The cap 4 has a cover surface 40, surrounded by a marginal revolving jacket wall 41. On the outside, the jacket wall 41 encompasses chamfers 42, which increase the grip of the cap 4. On the jacket interior, a thread 43 is mounted, which is designed as a fine thread 43 meshes with the external thread 22 of the pouring nozzle 2. On the lower side of the cover surface 40, a revolving annular bead 44 is available, which can be mounted on the exterior of a ring wall 45. The ring wall 45 runs concentrically to the jacket wall 41. Furthermore, at least one catch 46 is integrally molded on the lower side of the cover surface 40 of the cap 4. The at least one catch 46 is directed or protrudes at right angles from the cover surface axially downwards and also runs slightly in the direction of the center. The catch 46 is integrally designed on an interior ring wall 47 as an extension. The catch 46 interacts with the catch 39 at the cutting element 3.

Also, a tamper-proof seal 48, which is connected to the lower edge of the jacket wall 41 via weakened bridges 49, is integrally molded on the cap 4. The previously-mentioned separating agents 24 reach between two adjacent weakened bridges 49 between the lower edge of the jacket wall and the upper edge of the tamper-proof seal through the corresponding gap.

The semifinished product illustrated in FIG. 1 can be fitted without problems. The weakened bridges 34 will thus tear in the region of the connection point, virtually without causing a residue at the jacket wall interior surface of the cylindrical pipe section 20, wherein the main part of the weakened bridge 34 remains in the region of or near the lower rim 33 of the cutting element 3. They thus interfere only marginally because the external thread 31 at the cylindrical pipe section 30 and the internal thread 23 at the cylindrical pipe section 20 of the pouring nozzle 2 do not provide for a multiple use and because a potential scratching of the thread is completely unproblematic in response to the one-time use. The thread itself also does not need to be compact. Contrary thereto, as already mentioned above, the internal surface of the cylindrical pipe section 20 remains virtually undamaged so that a ring wall 45, which dips into this region during the later use is capable to form an absolute seal with an annular bead 44.

Figure 4:
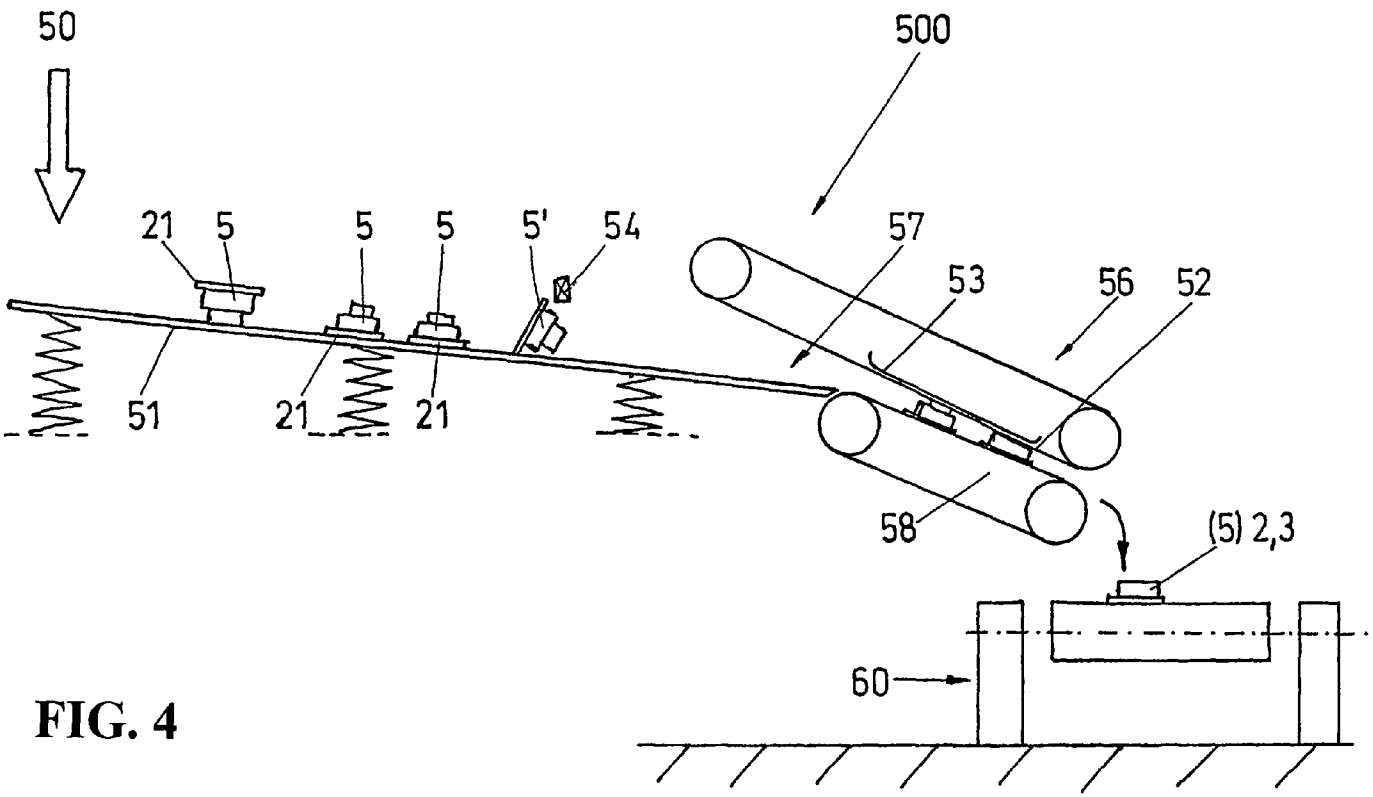
FIG. 4 shows diagrammatically, in a simplified manner, a fitting station which operates according to the method of this invention.

With reference to the fitting method according to this invention, reference is made to FIG. 4. The fitting method illustrated herein, which only shows the fitting of the semifinished product is understood to be very diagrammatic and it goes without saying that it is subject to different supplementations or changes by experts. The supply of the semifinished products is characterized with element reference numeral 50. The semifinished products can reach directly from the injection molding machines via conveyor belts to the fitting station, which is collectively characterized with element reference numeral 500. The semifinished products can also be supplied to the fitting station 500 by an intermediate storage.

The fitting station 500 comprises a first supply surface 51, which can be designed as a conveyor belt or, as illustrated herein, as a vibrating surface. The semifinished products 5 bear on the supply surface 51 in an unsorted manner as bulk goods and are separated by the vibrating motion so that even adjacent semifinished products 5 with their flange 21 of the pouring nozzle 2 do not reach into the compression region 56 so as to be located on top of one another in an overlapping manner. In the normal case, the semifinished products will come to bear on the supply surface 51 either on their flange 21 or on the upper rim 32 of the cutting element 3. It may happen sporadically that the semifinished products, as is indicated with 5', bear on the supply surface 51 in a tilted position, wherein provision is made above the supply surface 51 for a crossing arbor 54, which is arranged above the supply surface 51 to the extent that a semifinished product 5', which is located in such an inclined manner, comes to bear on the crossing arbor 54 with its flange, whereby a torque takes effect on the semifinished product 5' so that the semifinished product performs a tilting motion and comes to rest on the flange 21. The semifinished products reach the actual compression region 56 through an inlet gap 57. The compression region 56 is formed by a lower support conveyor belt 58 and by an upper conveyor belt, which acts as a continuous compression surface. The compression surface 52 and the lower support conveyor belt 58, which is a part and a continuation of the supply surface 51, merge in the compression region 56 to the extent that they are distanced from one another at the insertion side by at least the height of the semifinished product from the flange lower side 21 to the upper rim 32 of the cutting element 3, while a distance is available at the end of the compression region 56 between the supply surface in this region and the compression surface, which corresponds to the height of the pouring nozzle 2. The compression surface 52 and the actual belt of the conveyor belt, respectively, which forms the compression surface 52, can be provided with a rubber-elastic support so that certain tolerances are compensated for and press the cutting element 3 into the pouring nozzle 2 with a small dipping depth. In this case, the upper rim 32 of the cutting element 3 comes to rest slightly below the upper rim 25 of the pouring nozzle 2. Preferably, this difference is a few tenth of a millimeter. This distance can also be greater, only if these are semifinished products for relatively large opening devices. To keep the belt from avoiding the compression surface 52, a counter compression element 53 can be mounted on the leading side of the conveyor belt on the rear side thereof.

For the person of skill in the art, instead of a vibrating surface, the supply surface 51 can also be designed as a conveyor belt. In this case, the lower conveyor belt, which is available in the compression region 56, can simply be designed to extend across the entire length of the fitting station 500. In this case, the surface also does not need to run so as to be bent, as is illustrated in the drawing. The advantage of the solution shown is that a manual engagement can take place, should a jam arise in the region of the crossing arbor 54. Both of the parts, which formed the semifinished product, are now directed in fitted state via the guidance 60. The fitting of the cap on the already prefitted pouring nozzles and cutting elements is performed in a next step, which, however, is no longer the object of this invention.

The invention claimed is:

1. A closable opening device (1) for a sealed packaging, including a flowable medium, wherein the device encompasses a pouring nozzle (2) with a flange (21) which has an internal thread (23) and an external thread (22), a cylindrical cutting element (3) with an upper rim (32) which defines a planar surface, while a lower rim (33) has one tooth or a plurality of teeth (35), an internal jacket surface which has catches (39) acting in a radial direction and which interact with catches (46) in a screw cap (4), wherein the pouring nozzle (2) with the flange (21) and the cylindrical cutting element (3) are produced as a one-piece semifinished product (5) connected to one another via weakened bridges (34), wherein the cylindrical cutting element (3) of the semifinished product (5) is integrally molded near an upper rim (25) of the pouring nozzle (2), the opening device (1) comprising a revolving shoulder (38) protruding outwardly at the lower rim (33) of the cutting element (3) above the teeth and the external thread (31) mounted above the shoulder and a plurality of connected weakened bridges (34) in a non-fitted position near the upper rim (25) of the pouring nozzle (2).

2. The opening device according to claim 1, wherein the weakened bridges (34) with pointy ends are arranged and directed in a radially outward direction.

3. The opening device according to claim 2, wherein the weakened bridges (34) encompass the lower rim or the upper rim, which is directed towards the pouring nozzle (2) and which is aligned at least approximately with the upper rim (25) of the pouring nozzle.

4. The opening device according to claim 1, wherein the weakened bridges (34) are designed to a revolving destructible ring-shaped membrane.

5. The opening device according to claim 1, wherein the screw cap (4) encompasses a tamper-proof seal (48) integrally molded on a jacket wall (41) which in a fitted state prior to an initial opening of the opening device is held relative to the flange (21) so that a ring-shaped sealing bead (44) integrally molded on the interior of a cover surface of the cap (4) is located above both the upper rim (32) of the cutting element (3) and the upper rim (25) of the pouring nozzle (2).

6. The opening device according to claim 1, wherein a method for fitting the closable opening device comprises the semifinished product (5) brought to bear on a supply surface (51) with a lower side of the flange or with the upper rim (32)

of the cylindrical cutting element (3), which defines a planar surface, wherein a second pressing surface (52) which approaches the supply surface (51) comes to bear on the semifinished product (5), and the two surfaces (51, 52) approach one another to the extent that two parts (2, 3) of the semifinished product (5) are pushed into one another to destroy the connections, until the upper rim (32) of the cylindrical cutting element (3) is located at least approximately aligned in a plane with the upper rim (25) of the pouring nozzle (2).

7. The method according to claim 6, wherein the semifinished product (5) is located to be undirected on the supply surface (51) and is passed below an arbor (54) crossing the supply surface, wherein when the semifinished product (5) is not bearing on the upper rim (32) of the cutting element (3) or on the flange (21) of the pouring nozzle (2) in a planar manner the semifinished product (5) is tilted.

8. The method according to claim 6, wherein the opening device (1) is mounted on the supply surface (51) so that the opening device (1) bears thereon with the flange (21), while the second pressing surface (52) is a belt with a rubber-elastic support, which presses the cylindrical cutting element (3) into the pouring nozzle (2) to the extent that the upper rim (32) of the cutting elements (3) is pushed in several tenth of a millimeter below the upper rim (25) of the pouring nozzle (2).

* * * * *